United States Patent [19]

Tsumiyama

[11] Patent Number: 4,615,312

[45] Date of Patent: Oct. 7, 1986

[54] MOTORCYCLE ENGINE HAVING AUTOMATIC DECOMPRESSION DEVICE

[75] Inventor: Yoshinori Tsumiyama, Akashi, Japan

[73] Assignee: Kawasaki Jukogyo Kabushiki Kaisha, Kobe, Japan

[21] Appl. No.: 637,123

[22] Filed: Aug. 2, 1984

[30] Foreign Application Priority Data

Aug. 10, 1983 [JP] Japan ..... 58-147249

[51] Int. Cl.[4] ..... F01L 13/08

[52] U.S. Cl. ..... 123/182; 123/90.16; 123/90.27

[58] Field of Search ..... 123/182, 90.16, 90.27, 123/90.17

[56] References Cited

U.S. PATENT DOCUMENTS

| | | | |
|---|---|---|---|
| 3,314,408 | 4/1967 | Fenton | 123/182 |
| 3,381,676 | 5/1968 | Campen | 123/182 |
| 3,981,289 | 9/1976 | Harkness | 123/182 |
| 4,338,893 | 7/1982 | Pomfret et al. | 123/182 |
| 4,495,903 | 1/1985 | Asano | 123/90.27 |

*Primary Examiner*—Parshotam S. Lall

*Attorney, Agent, or Firm*—Leydig, Voit & Mayer, Ltd.

[57] ABSTRACT

A motorcycle engine having an automatic decompression device mounted to an end face of a camshaft of the engine for opening at least one valve by utilizing the centrifugal forces produced by the rotation of the camshaft in a compression stroke of the engine at engine startup.

2 Claims, 12 Drawing Figures

MOTORCYCLE ENGINE HAVING AUTOMATIC DECOMPRESSION DEVICE

BACKGROUND OF THE INVENTION

(1) FIELD OF THE INVENTION

This invention relates to internal combustion engines, and more particularly it is concerned with a four-cycle internal combustion engine of the type having suction valves and exhaust valves which is equipped with an automatic decompression device for reducing torque and power required for starting the engine by reducing the compression pressure in the cylinder at engine startup.

(2) DESCRIPTION OF THE PRIOR ART

A proposal has been made to use an automatic decompression device which is intended for use with engines of all the types, as discloses in Japanese Utility Model Publication No. 20486/81. This device is capable of improving starting characteristics by automatically opening a valve (an exhaust valve, for example) in a compression stroke at engine startup to thereby decompress the combustion chamber.

In the aforesaid device, a camshaft is journalled at one end portion thereof by a bearing mounted at the crankcase, and a cylindrical holder equipped with a centrifugal cam portion for decompression is fitted over the camshaft and secured in place between the bearings and cam. In this arrangement, two bearings by which the camshaft is journalled are spaced apart from each other a large distance, making it impossible to obtain a compact overall size in an engine. Moreover, in this device, a bending moment caused in the camshaft increases and makes it necessary to increase the strength of the camshaft by increasing its thickness. This inevitably increases the weight of the device.

In view of the aforesaid problems, no attempts have hitherto been made to equip a motorcycle engine with a centrifugal type automatic decompression device. Many motorcycle engines have had a decompression mechanism of low efficiency which is either manually actuated or linked to a kickoff starting device. Thus, there has been a demand for an automatic decompression device which is light in weight, compact in size and reliable in performance.

SUMMARY OF THE INVENTION

(1) OBJECT OF THE INVENTION

This invention has as its object the provision of a motorcycle engine equipped with an automatic decompression device which is light in weight, compact in size and reliable in performance in starting the engine while requiring no more space than is necessary for mounting it.

(2) STATEMENT OF THE INVENTION

To accomplish the aforesaid object, the invention provides a motorcycle engine comprising a camshaft, a cam, a valve for a combustion chamber of the engine, a valve-operating structure, and an automatic decomposition mechanism. The camshaft is journalled by a bearing and has an overhang portion adjacent the bearing, the overhang portion of the camshaft including an end face. The cam is mounted on the overhang portion of the camshaft. The valve-operating structure is positioned against the cam and operable thereby for controlling the opening and closing of the valve. The automatic decompression mechanism is mounted on the end face of the overhang portion of the camshaft and comprises an auxiliary cam having a decompression position locating the valve-operating structure to open the valve when the engine is in a low speed range at engine startup and movable radially of the camshaft by centrifugal forces produced by the rotation of the camshaft to locate the valve-operating structure to close the valve and allow the normal compression pressure in the combustion chamber in an operating speed range.

Other and further objects, features and advantages of the invention will appear more fully from the following description.

DETAILED DESCRIPTION OF THE PREFERRED EMBODIMENT

Figure 1:
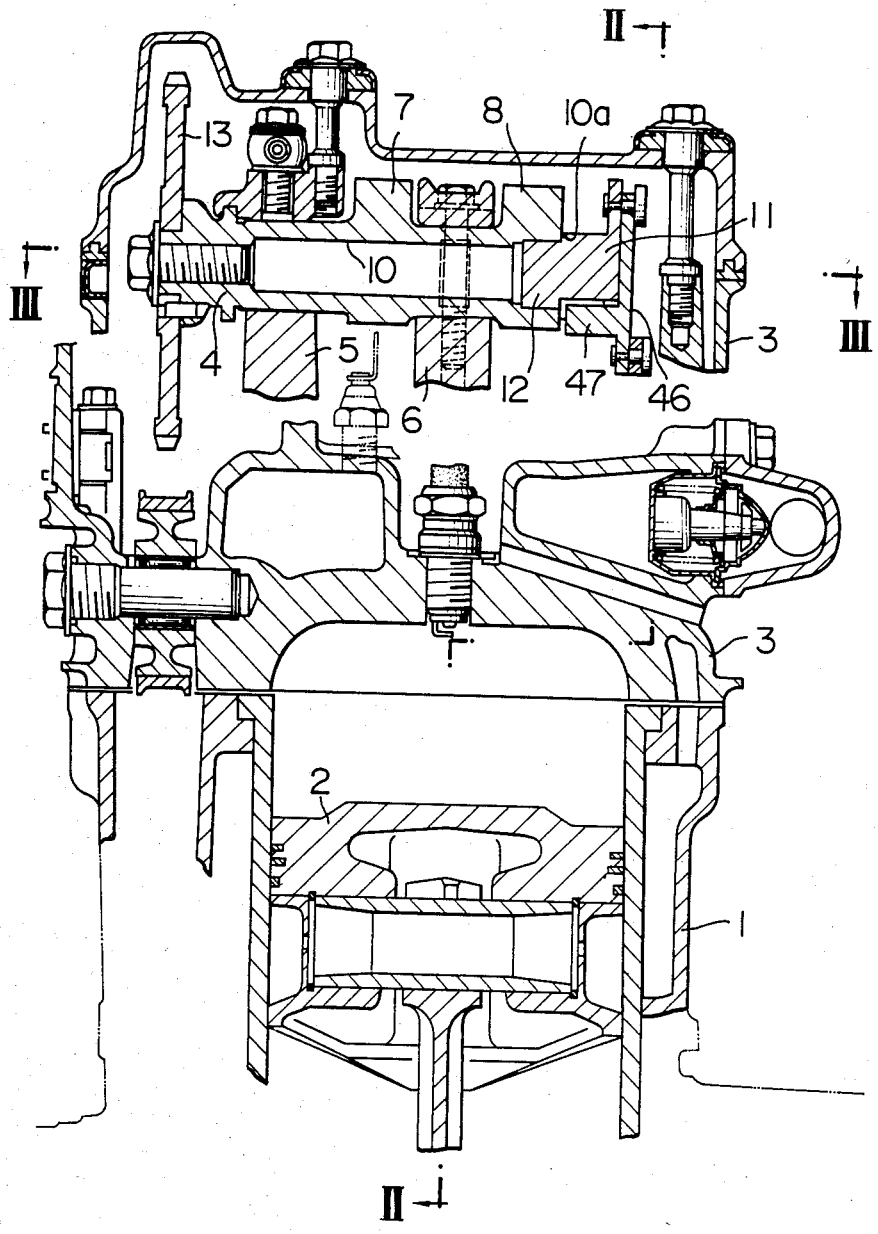
FIG. 1 is a vertical sectional view of a motorcycle engine incorporating the present invention therein.

Referring to FIG. 1 showing in a vertical sectional view a motorcycle engine in which the present invention is incorporated, a cylinder 1 having a piston 2 fitted therein has a cylinder head 3 secured to its upper portion. An exhaust-side camshaft 4 is journalled by a pair of bearings 5 and 6 disposed close to each other within the cylinder head 3. The camshaft 4 supports a pair of cams 7 and 8 therein, with cam 7 interposed between the bearings 5 and 6 and cam 8 located on the overhang axially outside of the bearing 6. A bore 10 formed in the camshaft 4 provides a passage for a lubricant, and a protruberance 12 formed integrally with a holder 11 of the automatic decompression device according to the invention, which serves concurrently as a plug for lubricant, is force fitted concentrically in a major diameter portion 10*a* of the bore 10. A sprocket wheel 13 is secured to a projecting end portion opposite the major diameter portion 10*a* of the camshaft 4 and connected to another sprocket wheel, not shown, of a crankshaft, not shown, through an endless chain, not shown.

Figure 2:
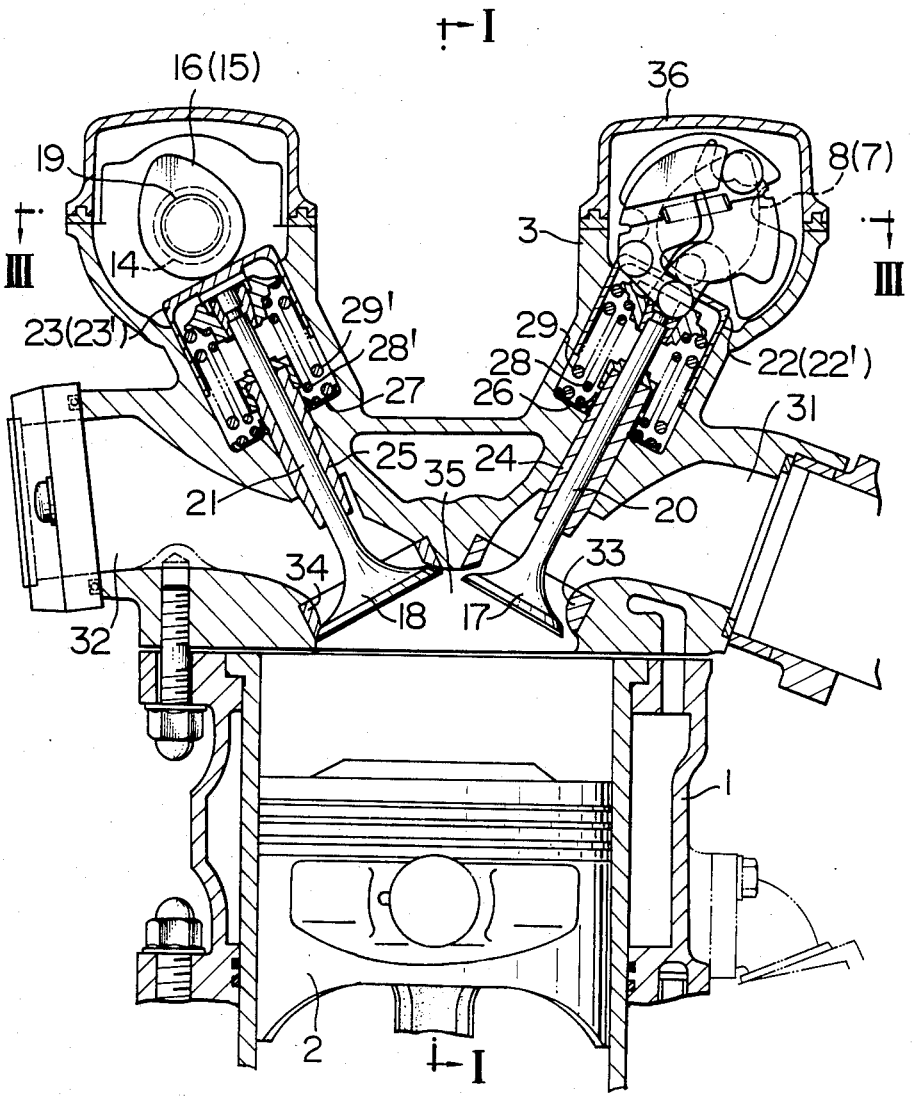
FIG. 2 is a sectional view taken along the II—II lines in FIG. 1.

Referring to FIG. 2 which is a sectional view taken along the II—II line in FIG. 1, a suction-side camshaft 4 of a cylindrical configuration is supported like the exhaust side camshaft 4 and connected to the crankshaft. The camshaft 14 has a pair of cams 15 and 16, and a plug 19 is force fitted in one projecting end of the camshaft 14. A pair of exhaust valves 17 and a pair of suction valves 18 are connected through stems 20 and 21 which are integral with the valves 17 and 18 to a pair of tappets 22 and 22' and a pair of tappets 23 and 23', respectively. The tappets 22, 22', 23 and 23' are positioned against the cams 8, 7, 16 and 15, respectively. Valve holders 24 and 25 of a cylindrical configuration secured to the cylinder head 3 have spring receivers 26 and 27 formed integrally therewith, respectively, and springs 28 and 29 and springs 28' and 29' are mounted in compressed condition between the spring receivers 28 and 29 and the tappets 22 and 23, respectively. An exhaust port 31 and a suction port 32 are maintained in communication with a combustion chamber 35 through a pair of valve seats 33 and a pair of valve seats 34, respectively. A cylinder head cover 36 substantially in the form of a letter U is located above the camshafts 4 and 14.

Figure 3:
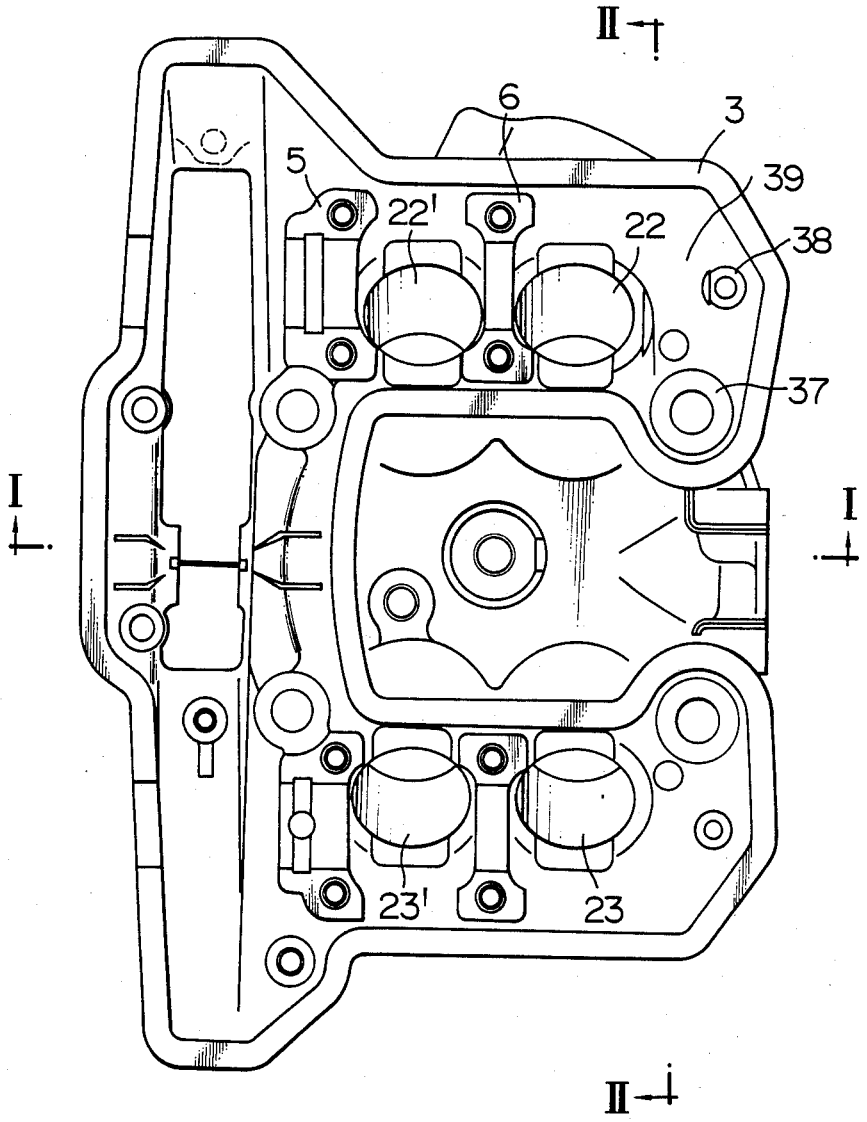
FIG. 3 is a plan view of the cylinder head section of the engine shown in FIG. 1, with the camshafts being removed.
Figure 6:
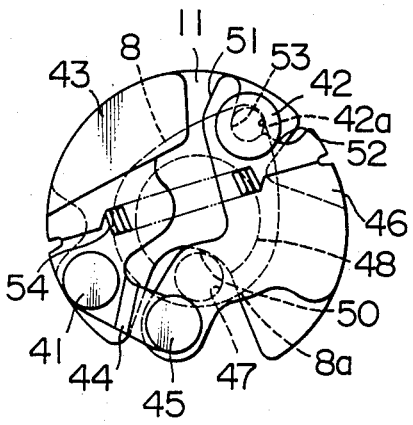
FIGS. 6 and 7 are views corresponding to FIGS. 4 and 5, respectively, and showing the conditions of the engine after startup.
Figure 10:
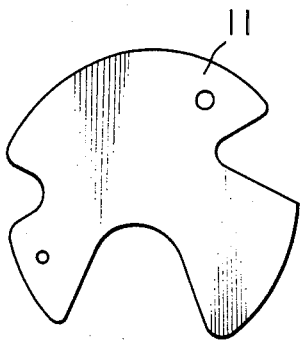
FIGS. 10, 11 and 12 are views of the holder, first centrifugal weight and second centrifugal weight, respectively.
Figure 11:
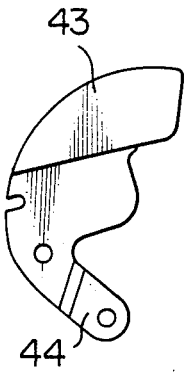
Figure 12:
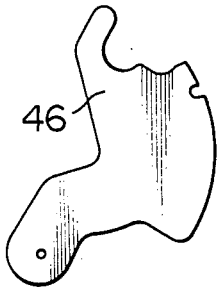

The essential portions of the automatic decompression device according to the invention will now be described. FIG. 3 is a plan view showing the cylinder head section while removing the two camshafts 4 and 14. As shown, the cylinder head 3 has, in the vicinity of the tappet 22, clamping seats 37 for clamping the cylinder head 3 to the cylinder 1 and clamping seats 38 for clamping the cylinder head cover 36 to the cylinder head 3, leaving a space 39 between the tappet 22 and clamping seats 37 and 38 which is vacant. The decompression device including the holder 11 according to the invention is mounted to the camshaft 4 by utilizing this vacant space. The decompression device according to the invention comprises, in addition to holder 11 shown in FIG. 10, a first centrifugal weight 43 shown in FIG. 11, a second centrifugal weight 46 shown in FIG. 12 and a spring 54 mounted between the first and second centrifugal weights 43 and 46 as shown in FIGS. 4 and 6.

Figure 4:
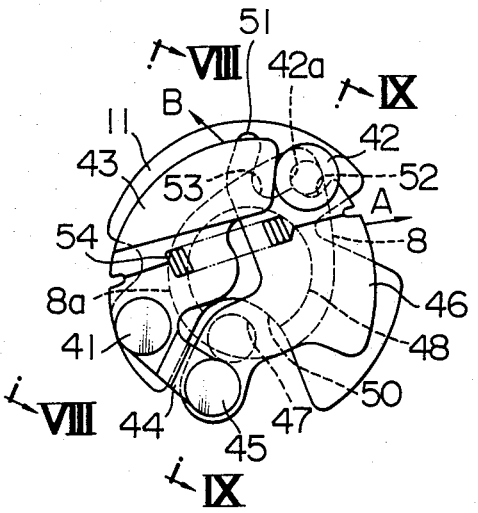
FIGS. 4 and 5 are a fragmentary enlarged view and a fragmentary enlarged schematic view, respectively, of the engine shown in FIG. 2.
Figure 8:
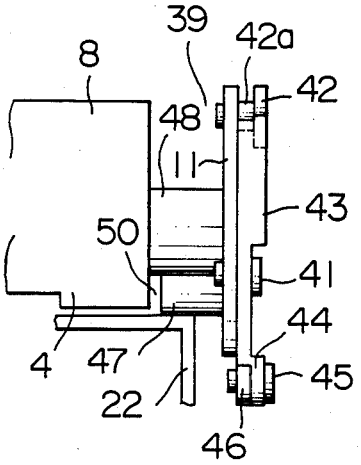
FIGS. 8 and 9 are sectional views taken along the VIII—VIII line and IX—IX line, respectively, in FIG. 4.
Figure 9:
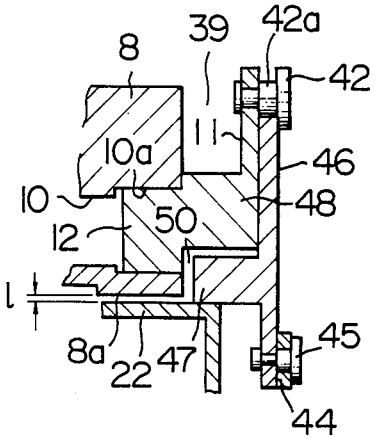

Referring to FIG. 4 which is an enlarged fragmentary view of the engine shown in FIG. 2, the holder 11 has a first pin 41 and a stopper pin 42 secured to the surface of the holder 11 in positions substantially symmetrical with respect to the axis of camshaft 4. The first centrifugal weight 43 is pivotably supported by the first pin 41 and includes an arm portion 44, integral therewith and projecting rightwardly in FIG. 8 a distance corresponding to its thickness while located in staggered relation to its main body, and pivotably connected to one end of the second centrifugal weight 46 by a second pin 45 (FIG. 9). A pillar-like cam portion (decompression cam) 47 is secured to the second centfifugal weight 46 in the vicinity of the pin 45 projecting toward the cam 8 while extending parallel to the camshaft 4 and located in a recess 50 formed in a major diameter portion 48 of the protruberance 12. The cam portion 47 (FIG. 5) which is substantially diametrically opposed to the vertex of the cam 8 or displaced by about 180 degrees in phase from the vertex of the cam 8 projects radially outwardly a small distance (decompression stroke l) from a base surface 8*a* of the cam 8 prior to engine startup, as subsequently to be described.

A projection 51 and first and second recesses 52 and 53 adjacent thereto (FIG. 4) are located in an end portion of the second centrifugal weight 46 opposite the end thereof at which it is pivotablly connected by the pin 45 to the arm 44 of the first centrifugal weight 43. Prior to engine startup, a minor diameter portion 42*a* of the stopper pin 42 is maintained in engagement in the first recess 52 by the biasing force of the spring 54 mounted in tentioned condition between the two centrifugal weights 43 and 46. The first centrifugal weight 43 engages at one end thereof the stopper pin 42.

Figure 5:
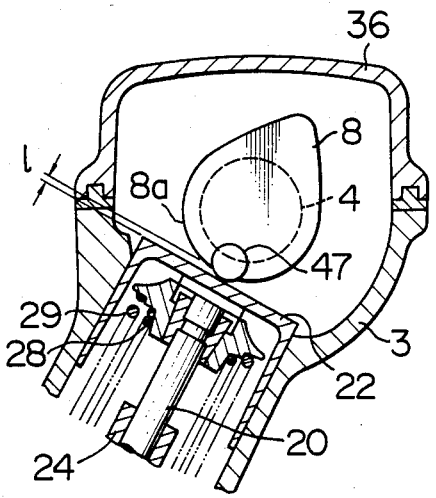

In operation, rotation of the crankshaft is transmitted through chains to the two camshafts 4 and 14. During the superlow speed operation of the engine startup, the biasing force of the spring 54 is higher than the centrifugal forces of the two centrifugal weights 43 and 46, so that the two centrifugal weights 43 and 46 are disposed in the relative positions shown in FIG. 4. The cam portion 47 (FIG. 5) abuts against the tappet 22 once while the camshaft 4 makes one complete revolution in a compression stroke to press the tappet 22 downwardly by a distance corresponding to the decompression stroke l, to thereby open one exhaust valve 17 (FIG. 2) and decompress the combustion chamber 35. At this time, the second centrifugal weight 46 (FIG. 4) is prevented from moving radially outwardly by the first recess 52, so that the cam portion 47 is kept from being withdrawn into the cam base surface 8A even if the forces of the springs 28 and 29 are exerted thereon through the tappet 22 (FIG. 5).

Figure 7:
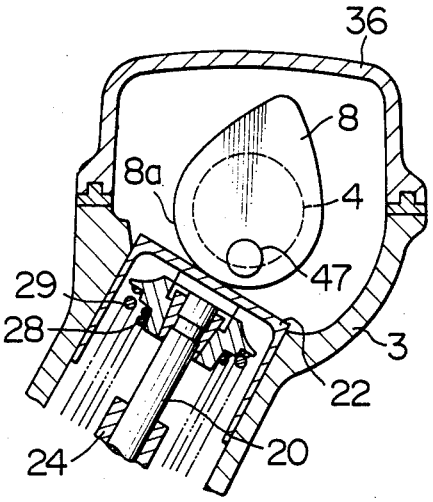

As the engine speed reaches the actual operation range (including idling and full load operation) following startup, the centrifugal force of the second centrifugal weight 46 overcomes the biasing force of the spring 54 and pivotally moves about the pin 45 in the direction of an arrow A in FIG. 4. This releases the minor diameter portion 42*a* of the stopper pin 42 from engagement in the first recess 52 and allows the projection 51 to abut against the minor diameter portion 42*a*. At the same time, the first centrifugal weight 43 pivotally moves about the pin 41 in the direction of an arrow B in FIG. 4, and the second centrifugal weight 46 moves to bring the minor diameter portion 42*a* of the stopper pin 42 into engagement with the second recess 53 (FIG. 6). This moves the cam portion 47 (FIG. 7) to the inside (radially inwardly) of the cam base surface 8*a*, so that the cam portion 47 is kept from being brought into contact with the tappet 22 even if the camshaft 4 rotates.

Immediately before the engine stops, the biasing force of the spring 54 brings the first centrifugal weight 43 into engagement with the stopper pin 42, and at the same time the second centrifugal weight 46 pivotally moves in a direction opposite the direction of the arrow A about the pin 45 to be restored to the position shown in FIG. 4.

In working the invention, the holder 11 may be connected to the camshaft 4, either threadably or by any other known means. The invention may also have application in a motorcycle of the type in which the exhaust valves 17 and suction valves 18 are connected to rocker arms and the cams 7, 8, 15 and 16 are positioned against the rocker arms. In the embodiment shown and described hereinabove and other applications, the holder 11 may be connected to the suction-side camshaft 14 to open the suction valves 18 and decompress the combustion chamber 35 at engine startup.

From the foregoing description, it will be appreciated that by equipping a motorcycle engine with the automatic decompression device according to the invention which comprises the cam 8 at the overhang of the camshaft 4, it is possible to greatly improve the starting characteristics of this type of motorcycle engine in such a manner that an engine of about 500–600 cc can be as readily and positively started as that of about 50 cc. When the engine is started by an electrical starter power consumption can be minimized, and the starting motor can be reduced in size and weight. The spacing between the bearings 5 and 6 can be reduced and the weight of the camshaft 4 can be reduced. When the bore of the camshaft 4 serves concurrently as a lubricant passage, the protruberance 12 of the holder 12 may serve concurrently as a plug. In the motorcycle engine of the type weight has the vacant space 39 in the vicinity of the clamping seats 37 and 38 (FIG. 3), it is possible to connect the holder 11 to the camshaft 4 in the vacant space 39. This eliminates the need to alter the construction of the cylinder head.

Having described a specific embodiment of out bearing, it is believed obvious that modification and variation thereof is possible in light of the above teachings.

What is claimed is:

1. A motorcycle engine comprising:

a camshaft journalled by bearing means and having an overhang portion adjacent said bearing means, said overhang portion of the camshaft including an end face;

a cam mounted on said overhang portion of said camshaft;

a valve for a combustion chamber of said engine;

valve operating means positioned against said cam and operable thereby for controlling the opening and closing of said valves; and an automatic decompression means mounted on the end face of said overhang portion of said camshaft and comprising an auxiliary cam having a decompression position locating said valve operating means to open said valve when the engine is in a low speed range at engine startup and movable radially of the camshaft by centrifugal forces produced by the rotation of the camshaft to locate said valve operating means to close said valve and allow the normal compression pressure in said combustion chamber in an operating speed range.

2. A motorcycle engine according to claim 1 wherein said decompression means comprises a holder supported on the end face of said camshaft, first and second centrifugal weights supported by said holder, and spring means between said weights, the biasing force of the spring means being higher than the centrifugal forces of the two weights during low speed operation of the engine.

* * * * *